US005086108A

United States Patent [19]

Hornsby

[11] Patent Number: 5,086,108

[45] Date of Patent: Feb. 4, 1992

[54] FIBRIDS LOADED WITH ELECTROMAGNETIC-WAVE OBSCORANTS

[75] Inventor: James C. Hornsby, Hendersonville, Tenn.

[73] Assignee: E. I. Du Pont de Nemours and Company, Wilmington, Del.

[21] Appl. No.: 331,385

[22] Filed: Mar. 31, 1989

[51] Int. Cl.[5] ..... C08J 5/12; C08K 3/08; C08L 1/12

[52] U.S. Cl. ..... 524/440; 524/420; 524/437; 524/439; 524/441

[58] Field of Search ..... 524/437, 439, 440, 441, 524/420

[56] References Cited

U.S. PATENT DOCUMENTS

| | | | |
|---|---|---|---|
| 2,988,782 | 6/1961 | Parrish et al. | 18/48 |
| 2,999,788 | 9/1961 | Morgan | 162/146 |
| 3,505,038 | 4/1970 | Luksch et al. | 29/183.5 |
| 3,756,908 | 9/1973 | Gross | 162/146 |
| 4,146,510 | 3/1979 | Miyanoki et al. | 521/64 |
| 4,397,907 | 8/1983 | Rosser et al. | 428/240 |
| 4,508,640 | 4/1985 | Kanda et al. | 524/441 |
| 4,533,685 | 8/1985 | Hudgin et al. | 524/441 |
| 4,566,990 | 1/1986 | Liu et al. | 524/439 |
| 4,582,872 | 4/1986 | Hugdin et al. | 524/439 |
| 4,606,848 | 8/1986 | Bond | 524/439 |

FOREIGN PATENT DOCUMENTS

| | | | |
|---|---|---|---|
| 0065754 | 4/1982 | Japan | 524/440 |

*Primary Examiner*—Paul R. Michl
*Assistant Examiner*—U. K. Rajguru

[57] ABSTRACT

Polymeric fibrids are loaded with particles that obscure the absorption or reflection of radar, infra-red or other electromagnetic waves. The loaded fibrids have settling rates that are slower than 5 meters per minute and are suited for use as air-borne obscurants of movements of military personnel and equipment.

5 Claims, No Drawings

FIBRIDS LOADED WITH ELECTROMAGNETIC-WAVE OBSCORANTS

BACKGROUND OF THE INVENTION

1. Field of the Invention

The present invention relates to polymeric fibrids that contain particulate matter. More specifically, the invention concerns such fibrids which are particularly suited for use as obscurants of radar, electromagnetic waves and the like.

2. Description of the Prior Art

Effective means have long been sought for hiding the movement of troops and equipment from visual detection or from detection by means of devices that depend on reflection or absorption of electomagnetic waves, such as radar or infra-red waves. Smoke screens, tinsel foil dropped from airplanes and the like have been used in the past. However, more effective obscurant means are needed.

Though not related to the above-described problem, fibrids formed from organic polymers and processes for their production are known, as for example, from Morgan, U.S. Pat. No. 2,999,788. Morgan also discloses that various materials can be added to the fibrids, such as dyes, antistatic agents, surfactants, fillers such as silica, titanium dioxide or sand, pigments, antioxidants, electroluminescent phosphors, bronze powder, metal filings, and the like. Parrish et al, U.S. Pat. No. 2,988,782, discloses a specific shear-precipitation process for making fibrids, and certain equipment (tube fibridators) that is particularly suited for carrying out the process. Parrish et al also discloses the inclusion of fillers and pigments. Gross, U.S. Pat. No. 3,756,908, discloses a process for preparing fibrids of aramid polymers. Miyanoki, U.S. Pat. No. 4,146,510, discloses various flash-spun polymeric fibrids which a variety of finely divided that can pass through a less-than-100-mesh screen and are no more than 500 microns in nominal size, for use in forming pulps, sheets, etc. Rosser et al, U.S. Pat. No. 4,397,907, discloses a supercooled fiber-forming polymer solution which is combined with metal, graphite, lead oxide, iron oxide or other particles and then the polymer is formed into 500 to $10^7$ Angstrom particles. The particles are trapped by or entangled with, but not encapsulated by, the polymeric particles, which then are optionally further beaten.

Some of the above-described particles have found use in papers and other nonwoven products, but none are disclosed as being air-dispersible.

Hugdin et al, U.S. Pat. No. 4,582,872 discloses that metallized polymers which are produced by melting metal and polymer together are suited for shielding electromagnetic interference. Luksch, U.S. Pat. No. 3,505,038, discloses "hair-like metal fibrils" that are dispersible or conveyable in air.

A purpose of the present invention is to provide loaded fibrids that can remain air-borne for a sufficiently long time (i.e., have a sufficiently slow settling rate) to be effective as electromagnetic-wave obscurants for hiding military operations.

SUMMARY OF THE INVENTION

The present invention provides polymeric fibrids loaded with an effective amount of an electromagnetic wave obscurant, the obscurant preferably being particles of conductive metal amounting to 30 to 70% of the total weight of the fibrids, and the loaded fibrids having an average size that passes through a 20-mesh screen and preferably is retained on 100-mesh screen and an average settling rate of no greater than 5 meters per minute, preferably less than 2 m/min and most preferably less than 1 m/min.

The present invention also provides a process for preparing the obscurant-loaded fibrids. The process includes shear precipitation of an organic polymer in the presence of an effective amount of particles of an electromagnetic wave obscurant. In a preferred process of the invention, the obscurant, in finely divided form, is uniformly dispersed in a polymer solution prior to the shear precipitation and after shear precipitation, the fibrids are dried and further reduced in size, as for example, by milling or shearing.

DESCRIPTION OF PREFERRED EMBODIMENTS

The invention is further illustrated by the following description of preferred embodiments. These embodiments and the examples that follow are included for the purposes of illustration and are not intended to limit the scope of the invention, which is defined by the appended claims.

As used herein, "electromagnetic wave obscurant" means a material that absorbs or reflects long wavelength electromagnetic radiation and includes radar and infrared radiation (i.e., a wavelength of at least 1,000 micrometers).

In accordance with the present invention the obscurant particles are incorporated, trapped or encapsulated in the fibrid. All such such fibrids are referred to herein as "loaded fibrids". Preferably, the polymer of the fibrid substantially completely encloses or covers the obscurant particles. The extent of encapsulation of the obscurant by the polymer can be evaluated with the aid of a Scanning Electron Microscope (SEM). The surface of the loaded fibrid is swept by a focused electron beam of the SCM. The scatt red and/or emitted electrons are detected electronically. The detector generates a signal which is collated on a cathode ray screen to produce an image. Examination of the loaded fibrids in this manner reveals how completely the obscurant particles are covered by polymer. In loaded fibrids made by preferred processes of the present invention, the obscurant particles are substantially completely covered with polymer. Even though obscurant particles may appear (under a microscope) to be only entrapped by the fibrid or on the surface of the fibrid, rather than deeply embedded within it, the obscurant particles nonetheless are covered or coated with fibrid polymer. Further evidence shows that the obscurant particles are covered by the polymer of the fibrids. Many of the iron particles incorporated into fibrids in accordance with the procedures of Examples 2, 4 and 7–9, below, do not appear, under an optical microscope, to be fully encapsulated within the polymer of the fibrid. Such iron particles usually oxidize very rapidly when exposed to air. However, examination of the iron-loaded fibrids after exposure to air for several weeks, revealed no signs of oxidation of the iron, thereby indicating that the iron particles were completely coated with the polymer. Also, it was noted that although the obscurant particles themselves conduct electricity, the obscurant-containing fibrids do not.

Electromagnetic wave obscurants suitable for loading into the fibrids of the present invention usually are conductors of electricity. For use in the present invention, the obscurants are usually in powdered or particulate form. Conductive obscurant materials include metals such as aluminum, copper, iron, nickel, and tungsten, metal alloys such as brass, carbon in graphite, coke or pitch form, salts such as copper sulfide and nickel sulfide, and the like. Suitable obscurants generally have a resistivity of less than 10,000 ohm-cms. To facilitate dispersion and incorporation of the obscurant in the polymeric fibrid, the obscurant particles usually have a maximum dimension or nominal particle size of less than about 50 microns, preferably, in the range of 0.1 to 2.5 microns.

Loaded fibrids usually contain obscurant particles amounting to no more than about 90% of the loaded fibrid weightand no less than 7.5%. When used as airborne electromagnetic wave obscurants, the obscuring capacity of loaded fibrids varies directly with the concentration of fibrids in the air, the concentration of obscurant in the fibrids, and the rate at which the fibrids settle to the ground. To maximize obscuring effectiveness, the obscurant content of the fibrid should be as high as is consistent with a slow settling rate. Optimum concentration of obscurant is usually in the range of about 30 to 70 percent by weight of the loaded fibrid.

Many polymers are suitable for loading with obscurant particles in accordance with the invention. Morgan, U.S. Pat. No. 2,999,788 lists many such polymers. Because the so-called "hard" polymers of Morgan are more amenable to reduction in particle size, "hard" polymers are preferred. Such polymers include acrylonitrile polymers and copolymers; polyacrylic and polymethacrylic esters; cellulose esters, such as cellulose acetate; polymers and copolymers of vinyl chloride; polymers and copolymers of hydrocarbons, such as styrene, ethylene and propylene; polyesters, such as poly(ethylene terephthalate); polyamides, such as poly(-hexamethylene adipamide); aramid polymers, such as poly(p-phenylene terephthalamide) and poly(m-phenylene isophthalamide); and many others. Because they are bio-degradable, cellulosic fibrids are preferred for use in the present invention.

In accordance with the present invention, the average size of the fibrids is usually no greater than that of fibrids which pass through a 20-mesh screen. Fibrids that pass through a 400-mesh screen are generally undesirable. Such small particles can be a respiratory hazard. Preferably, the smallest fibrids of the present invention will not pass through (i.e., they are retained on) a 100-mesh screen.

In accordance with the process of the invention, loaded fibrids are prepared by uniformly dispersing finely divided obscurant particles in a solution of polymer. The thusly formed dispersion is combined with a precipitant. Suitable precipitants are liquids in which the polymer can dissolve to no more than a 3% concentration (based on precipitant weight). Usually, the precipitant is at least slightly miscible with the polymer solvent. Preferably, the precipitant is completely miscible with the polymer solvent in the proportions used. Extensive information on the conditions required to form fibrids is described in Parrish et al, U.S. Pat. No. 2,988,782, the entire disclosure of which is hereby incorporated herein by reference. Although there are differences in conditions for specific combinations of polymer solution and precipitant, the directions of Parrish et al are generally applicable to the preparation of the fibrids of the present invention.

In preparing fibrids according to the invention, shearing of the polymer solutions can be performed by stirrers, the stirring blades or paddles of which are set at angles to the plane of rotation of the paddles or blades. The stirrer blade of a conventional Waring Blendor has a particularly satisfactory pitch. Shear and turbulence can be increased by introducing suitable baffles in the mixing vessel. Other means can be used for shearing polymer solution, so long as the equipment subjects the solution to sufficient shear to form the desired fibrids. For example, the polymer solution can be sheared by passage between solid surfaces which are in relative motion, such as between counter-rotating discs or between a rotating disc and a stationary disc or in a "tube fibridator", in which polymer solution is introduced through an orifice or series of orifices in the tube wall to subject the solution to high shear.

Freshly-precipitated fibrids produced by the shear precipitation step are filtered, washed to remove solvent and precipitant, and then dried (as for example in a vacuum oven or by freeze drying). Dried fibrids of the invention can be dispersed in a current of air. However, the dried fibrids prepared as described above frequently form a cake that is somewhat difficult to separate into individual, dispersible fibrids. Also, the loaded fibrids may require a further reduction in size. Separation of the fibrids and further size reduction fibrids can be accomplished by milling, by additional shearing (as in a Waring Blendor) or by seiving to remove larger-fibrid fractions.

In use, the fibrids may be made air-borne by being dropped from airplanes, raised aloft by thermal currents, dispersed by rockets, propelled from containers by gasses under pressure, fired into the air with mortar or artillery shells, or the like. Because of their very slow settling rates and the loaded fibrids of the invention are effective electromagnetic-wave obscurants.

Test Procedures

Several parameters and characteristics of the loaded fibrids of the invention are reported herein. These can be measured by the following test methods.

Settling rate of a fibrid sample is measured in a column of still air, provided inside a glass pipe, measuring 5.1 cm (2 inches) in diameter and 1.22 meters (48 inches) in length, the lower end of which is inserted into a sealed container. A first point for observing falling particles is located 19 cm (7.5 inches) below the top of the column. A second observation point is located 25.4 cm (10 inches) further down the column. The rate of descent of a fibrid of the invention has usually reached a stable constant value, by the falls to the first observation point. Initially the top of the column is covered by a 20-mesh screen.

To determine the settling rate of a particular batch of fibrids, an "elapsed time" is first measured, and then the settling rate of at least twenty-five individual fibrids, as follows. A first sample of about 25 milligrams of fibrids is placed atop the screen. The screen is gently tapped to cause the fibrids to fall through the screen and enter the air column. The screen is then replaced with a solid cover to assure that the column of air remains still. The time that elapses between when a first fibrid of the sample passes the first observation point and when the last fibrid of the sample passes that point is defined as the "elapsed time" for that sample of fibrids. Then, for each of the at-least-25 determinations of fibrid settling rate, a fresh 25-milligram sample is placed atop the screen; the screen is tapped; the screen is replaced by the cover; after a time period of one-half of the measured "elapsed time", the time required by a particular fibrid passing the first observation point to reach the second observation point is measured. The results of the at-least-25 determinations are averaged and reported as the settling rate in meters per minute.

The size of a sample of fibrids is determined by means of seive analysis. seive mesh. A Testing Sieve Shaker Model B made by W. S. Tyler, Inc. Combustion Engineering, Mentor, Ohio, is employed. The apparatus consists of a brass cylinder with a removable top and bottom and in which cylindrial brass screens of various standard mesh sizes are placed. The sides of the screens have a depth of about two inches. The screens used for determining the sizes reported herein are U.S. Standard Sieve Series purchased from Preiser Scientific Company. The particular sequence of mesh sizes employed is a 20-mesh screen as the top screen, followed by screens of 40, 60, 80, and 100 mesh. A weighed sample is placed atop the 20-mesh screen and the cover is put in place. The closed cylinder is then placed in a shaker which simultanously shakes the cylinder and taps the top which causes the particles of sizes less than that of a particular screen mesh to pass through the screen. After 45 seconds, the shaking is stopped and the amount of material collected on each screen and on the bottom is weighed. The particles on any screen can be characterized as having been unable to pass through a screen of that mesh but having been able to pass through the preceding screen.

The examples which follow are illustrative of the invention and the results reported therein are believed to be representative but do not constitute all the runs involving the indicated ingredients. In the examples, when a particle size is given in terms of a mesh size, the mesh refers to the seive on which the particles were retained in the hereinbefore-described seive test or it refers to the particle size quoted by the maufacturer of the particles.

EXAMPLES 1-7

These examples illustrate the preparation of various polymeric fibrids in which various powdered obscurants are loaded in accordance with the invention. Fibrids of acrylonitrile are loaded with aluminum and iron (Examples 1 and 2, respectively); fibrids of acrylonitrile copolymer, with copper (Example 3); fibrids of poly(m-phenylene isophthalamide) with iron and tungsten (Examples 4 and 5, respectively); and fibrids of cellulose acetate, with graphite and iron (Examples 6 and 7, respectively). Characteristics of the fibrids are summarized in Table I. The settling rates reported in Table 1 were determined by the above-described test and are for the fraction of the fibrids that pass through a 20-mesh U. S. Standard Seive.

EXAMPLE 1

To a three-neck 1-liter round-bottom flask, equipped with a mechanical stirrer and a nitrogen gas inlet, 279 grams of dimethylacetamide and 21 grams of polyacrylonitrile were added. The mixture was stirred at room temperature until a clear solution formed. Then, 21 grams of powdered aluminum was added to the solution, to form a suspension of the aluminum particles in the polymer solution. The aluminum particles were obtained from Cerac, Inc., 407 13th St., Milwaukee, Wis. 53233 and were of 1 micron or less in size. The thusly formed suspension was added slowly to a 0.5% aqueous solution of sodium alginate, while being stirred vigorously in a Waring Blendor, to form a suspension of polymeric fibrids in which the aluminum particles were loaded. The fibrids were filtered, washed with acetone, and dried in air. The fibrids contained about 50% by weight of aluminum and had settling rates of 3.6 meters/min.

EXAMPLE 2

A polymer solution was prepared in the apparatus of Example 1 by adding 14 grams of polyacrylonitrile to 186 grams of stirred dimethylacetamide to form a clear solution. To the stirred clear solution, 28 grams of iron particles which passed through a 325-mesh screen (nominal diameter of about 44 microns) were added. Stirring was continued until the iron particles were well dispersed. The dispersion was then added to a vigorously stirred 50/50 mixture of glycerol and water in a Waring Blendor to produce iron-loaded acrylonitrile fibrids. The fibrids were washed with water and then acetone, and then dried in air. The loaded fibrids contained about 67% by weight of iron. The settling rate of the iron-loaded fibrids was 4.6 m/min.

EXAMPLE 3

In the same apparatus as was used in Example 1, 79 grams of dimethylacetamide were added and chilled to −20° C. While being stirred, 21 grams of a copolymer containing, by weight, 93.2% acrylonitrile, 6% methyl acrylate, and 0.8% sodium styrene sulfonate were added to the chilled liquid. When the addition of the copolymer was completed, cooling was stopped, but stirring was continued as the temperature rose to room temperature and continued thereafter for about 16 hours. A clear polymer solution was obtained. Then, while stirring continued, 21 grams of pulverized copper were added to the clear polymer solution to thoroughly disperse the copper in the solution. The thusly formed dispersion was added slowly to a vigorously stirred 0.5% aqueous solution of sodium alginate in a Waring Blendor to form fibrids in which copper particles were loaded. The copper-loaded fibrids were washed with water and then acetone and then dried under vacuum. The copper content of the fibrids was found to be 34.6%. Apparently, some of the copper was not incorporated in the fibrids. The settling rate of the fibrids (labelled Example 3a in Table I) was measured to be 4.7 m/min.

A portion of the dried copper-loaded fibrids was further reduced in size by being subjected to shearing in a Waring Blendor operating at high speed for about one minute. The smaller copper-loaded fibrids (labelled Example 3b in Table I) had a settling rate of 3.9 m/min.

EXAMPLE 4

To 143 grams of a dimethylacetamide solution containing (by weight) 9% calcium chloride, 1.5% water, and 19.3% poly(m-phenylene isophthalamide) in the apparatus of Example 1, 93 grams of dimethylacetamide were added. The mixture was stirred until a uniform dilute solution formed. This dilute solution contained 7% by weight of solid material. Twenty grams of 325-mesh iron powder (from Peerless Metal Powders, Inc.) were added to the dilute solution and the mixture was stirred until a uniform dispersion was formed. The dispersion was poured slowly into a Waring Blendor containing 500 $cm^3$ of a vigorously stirred 60/40 (by volume) mixture of water and dimethylacetamide. Iron-loaded fibrids were produced, collected on a Buchner funnel, washed with water, then with acetone, and then dried under vacuum at 80° C. These fibrids contained about 67% by weight of iron. The dried fibrids were reduced in size in a Waring Blendor. The smaller size fibrids had a settling rate of 1.1 m/min.

EXAMPLE 5

To 80 grams of the poly(m-phenylene isophthalamide) polymer solution in dimethylacetamide of the Example 4, 20 grams of tunsten powder having an average diameter of 500 micrometers in diameter were added with stirring. An additional 200 grams of dimethylacetamide was added to the stirred mixture. The resulting slurry was added to a 50/50 mixture of water and diamethylacetamide in a Waring Blendor operating at full speed to form tungsten-loaded fibrids. The loaded fibrids were rinsed with water. Three grams of an anionic surfactant were added to the rinsed fibrids, which were then placed in two liters of boiling water for two hours. The tungsten content was about 56% of the total weight of the loaded fibrid. The loaded fibrids were filtered, washed three times with water, and dried under vacuum at 110° C. The dried fibrids were further reduced in size in a Waring Blendor. The resultant fibrids had a settling rate of 1.8 m/min.

EXAMPLE 6

In the apparatus of Example 1, a solution was prepared by dissolving 7 grams of cellulose acetate in 93 grams of dimethylacetamide. To the solution, 14 grams of 325-mesh graphite (J. T. Baker Technical Grade) were added and stirred until a uniform dispersion was obtained The dispersion was poured slowly into a Waring Blendor containing 350 $cm^3$ of a vigorously stirred 50/50 mixture of water and glycerol. Graphite-loaded fibrids were produced in which the graphite amounted to about 67% by weight of the loaded fibrids. The loaded fibrids were collected in a Buchner funnel, washed with water, and then dried under vacuum at approximately 90° C. The dried fibrids were reduced in size in a Waring Blendor. The resultant fibrids had a setting rate of 0.6 m/min.

EXAMPLE 7

An iron powder, of the same type as was used in Example 4, and a process of the general type that was employed in Example 6, were used to prepare cellulose acetate fibrids containing approximately 67% by weight of iron. A waterleaf handsheet was prepared by pouring a slurry of these fibrids onto a wire screen. The handsheet was dried and reduced to small size particles in a Waring Blendor. The resultant fibrid particles were sieved to two classifications: (a) fibrids that passed a 40-mesh screen but were retained by a 60-mesh screen and (b) fibrids that passed through the 60-mesh screen. The settling rate of each classification of iron-loaded fibrids was about the same, about 0.5 m/min.

TABLE 1

Settling Rates of Fibrids of Examples 1-7

| Example No. | Fibrid Polymer[1] | Encapsulated Obscurant Powder | Encapsulated Obscurant Percent[2] | Settling Rate m/min |
|---|---|---|---|---|
| 1 | AN | Aluminum | 50 | 3.6 |
| 2 | AN | Iron | 67 | 4.6 |
| 3a | AN/MA/SSS | Copper | 35 | 4.7 |

TABLE 1-continued

Settling Rates of Fibrids of Examples 1-7

| Example No. | Fibrid Polymer[1] | Encapsulated Obscurant Powder | Encapsulated Obscurant Percent[2] | Settling Rate m/min |
|---|---|---|---|---|
| 3b | AN/MA/SSS | Copper | 35 | 3.9 |
| 4 | MPDI | Iron | 67 | 1.1 |
| 5 | MPDI | Tungsten | 56 | 1.8 |
| 6 | CA | Graphite | 67 | 0.6 |
| 7a | CA | Iron | 67 | 0.5 |
| 7b | CA | Iron | 67 | 0.5 |

Notes:
[1]AN = acrylonitrile polymer
AN/MA/SSS = copolymer of 93.2% acrylonitrile, 6% methyl acrylate and 0.8% sodium styrene sulfonate
MPDI = poly(m-phenylene isophthalamide) polymer
CA = cellulose acetate polymer
[2]By total weight of loaded fibrid

EXAMPLES 8-9

Examples 8 and 9 illustrates (a) the size distribution of fibrids of the invention and (b) the further reducing of dried, shear-precipitated fibrids in size. These effects are shown with cellulose acetate fibrids, in which iron obscurant particles, amounting to two-thirds of the total fibrid weight, are loaded.

Fibrids, prepared by shear-precipitation techniques substantially as described in Example 7, were dried and reduced in size by shearing in a Waring Blendor operated at high speed for about one minute. For the fibrids of Example 8, a 10% cellulose acetate polymer solution was shear precipitated; for Example 9, a 7% solution was used. The original shear-precipitated portion is referred to as part "a" of each example; the additionally sheared portion, as part "b". The results of seive size distribution analysis of the thusly prepared fibrids are summarized in Table 2 below, in which all percentages are by weight of the total sample.

Settling rates of seived fractions of the fibrids which passed through a 100-mesh U. S. Standard Seive were determined and, as recorded in the table, was in the range of 0.4 to 1.0 m/min.

TABLE 2

Size Distribution of Fibrids of Examples 8-9

| Example No. Fibrids | 8a As-made | 8b Reduced | 9a As-made | 9b Reduced |
|---|---|---|---|---|
| % retained on: | | | | |
| 40-mesh screen | 37.7 | 21.5 | 22.7 | 8.1 |
| 60-mesh screen | 7.7 | 37.9 | 22.0 | 25.4 |
| 80-mesh screen | 0.7 | 13.8 | 7.3 | 17.2 |
| 100-mesh screen | 0.2 | 6.5 | 3.2 | 9.8 |
| % passing through: | | | | |
| 20-mesh screen | 46.6 | 95.9 | 61.3 | 94.7 |
| 100-mesh screen | 0.1 | 16.2 | 6.2 | 34.2 |
| Settling Rate m/min Of fibrids passing 100-mesh screen | 1.0 | 0.7 | 0.7 | 0.4 |

I claim:

1. Polymeric fibrids, particularly suited for use as air-borne electromagnetic wave obscurants, said fibrids being of cellulose acetate polymer or of poly(m-phenylene isophthalamide) polymer, the polymer being loaded with an obscurant powder amounting to between 30 and 70% of the total weight of the fibrids, said fibrids being of a size that passes through a 20-mesh screen but does not pass through a 100-mesh screen and said fibrids having a settling rate of no greater than 2 meters per minute.

2. Fibrids in accordance with claim 1 wherein the fibrid polymer is cellulose acetate and the obscurant powder is of iron.

3. Fibrids in accordance with claim 1 wherein the obscurant powder is selected from the group consisting of iron, copper, tungsten and aluminum.

4. A process for preparing the fibrids of claim 1, the process comprising the steps of forming a polymer solution of cellulose acetate polymer or poly(m-phenylene isophthalamide) polymer in dimethylacetamide solvent, dispersing finely divided electromagnetic-wave obscurant particles selected from the group of powders consisting of iron, copper, tungsten and aluminum in the polymer solution, the powder amounting to 30 to 70% by weight of the polymer, shear precipitating the obscurant-containing polymer solution to form loaded fibrids, separating the loaded fibrids from the solvent, drying the separated loaded fibrids, and classifying the dried loaded fibrids to obtain a fraction which passes through a 20-mesh screen but does not pass through a 100-mesh screen.

5. A process in accordance with claim 4 wherein the polymer is cellulose acetate, the powder is of iron and the dried fibrids are reduced in size.

* * * * *